US007867583B2

(12) United States Patent
Garner, II

(10) Patent No.: US 7,867,583 B2
(45) Date of Patent: Jan. 11, 2011

(54) ARTIFICIAL PLANT BARRIER SYSTEM

(76) Inventor: Robert Lee Garner, II, 930 Washington Ave., Third Floor, Miami Beach, FL (US) 33139

( * ) Notice: Subject to any disclaimer, the term of this patent is extended or adjusted under 35 U.S.C. 154(b) by 177 days.

(21) Appl. No.: 12/098,832

(22) Filed: Apr. 7, 2008

(65) Prior Publication Data

US 2009/0249690 A1 Oct. 8, 2009

(51) Int. Cl.
*A41G 33/06* (2006.01)

(52) U.S. Cl. ..... 428/20

(58) Field of Classification Search ..... 428/20
See application file for complete search history.

(56) References Cited

U.S. PATENT DOCUMENTS

| | | | | |
|---|---|---|---|---|
| 3,829,349 | A * | 8/1974 | Hermanson | 428/8 |
| 4,727,672 | A * | 3/1988 | Hill et al. | 43/4 |
| 5,320,884 | A * | 6/1994 | Tai et al. | 428/24 |
| 5,631,059 | A | 5/1997 | Liao | |
| 5,759,645 | A | 6/1998 | Li | |
| 6,599,591 | B1 | 7/2003 | Scott | |

OTHER PUBLICATIONS

"Silk Ficus Tree Looks Real Holds Leaves"; www.ficustree.com/silk-ficus-tree.php, Feb. 11, 2008.

* cited by examiner

*Primary Examiner*—Aaron Austin
(74) *Attorney, Agent, or Firm*—Steven M. Greenberg, Esq.; Carey Rodriguez Greenberg & Paul LLP

(57) ABSTRACT

Embodiments of the present invention address deficiencies of the art in respect to plant hedges or barriers and provide a method, system and apparatus for creating artificial plant hedges or barriers. In one embodiment of the invention, an artificial plant barrier system can be provided. The system can include a starter unit, a middle unit coupled to a top of the starter unit, and a top end unit coupled to a top of the middle unit. The starter unit can include a channel defined between a first opening in a top of the starter unit and a second opening in a bottom of the starter unit, wherein the bottom of the starter unit is coupled to a base support. The middle unit can include a channel defined between a first opening of a top of the middle unit and a second opening of a bottom of the middle unit, wherein the bottom of the middle unit is coupled to the starter unit. The top end unit can include a channel defined between a top of the top end unit and a first opening of a bottom of the top end unit, wherein the bottom of the top end unit is coupled to the middle unit. The system can further include a support core assembly configured to interface with the channels of the starter unit, the middle unit and the top end unit.

3 Claims, 3 Drawing Sheets

ARTIFICIAL PLANT BARRIER SYSTEM

BACKGROUND OF THE INVENTION

1. Field of the Invention

The present invention relates to the field of artificial plant and shrub assemblies and more particularly to artificial plant and shrub assemblies used to construct barriers or hedges.

2. Description of the Related Art

It is known to use hedges of various types of plants as fences or barriers. Hedges are generally considered more attractive than artificial fences as they function effectively as a barrier to people and large animals, while affording privacy from onlookers. In spite of these advantages, the use of live hedges has a number of disadvantages. For example, a newly planted hedge may take a number of years to grow sufficiently to be effective as a barrier. During this period of time, an alternative barrier must be erected, which leads to additional expense, and frequently results in an unsightly provisional arrangement.

Another drawback of live plant hedges is when one or more of the plants of a hedge lose much of their foliage, e.g., defoliated by a storm, or even die, e.g., attacked by pests, which causes unsightly gaps in the face of the hedge. As such, new plants are typically required to replace the defoliated or deceased plants. Similarly, when renovations are being made to residential or commercial properties, some or all of the live plant hedges may need to be moved in order for workers and equipment to gain access to the renovation sites. The removal, replacement and/or temporary repositioning of live plant hedges can become cost prohibited.

Another problem concerns the use of live plants to create barriers for indoor renovation sites, e.g., in a hotel. The live plant barrier requires soil or potting material and proper watering. Soil and water from the live plant barrier can be misplaced or dispersed about the renovation site, which creates unsightly messes or safety hazards, especially in the areas adjacent to the renovation area perimeter.

BRIEF SUMMARY OF THE INVENTION

Embodiments of the present invention address deficiencies of the art in respect to plant hedges or barriers and provide a novel and non-obvious method, system and apparatus for creating artificial plant hedges or barriers. In one embodiment of the invention, an artificial plant barrier system can be provided. The system can include a starter unit, a middle unit coupled to a top of the starter unit, and a top end unit coupled to a top of the middle unit. In one aspect of the embodiment, the starter unit can include a channel defined between a first opening in a top of the starter unit and a second opening in a bottom of the starter unit, wherein the bottom of the starter unit is coupled to a base support.

In another aspect of the embodiment, the middle unit can include a channel defined between a first opening in a top of the middle unit and a second opening in a bottom of the middle unit, wherein the bottom of the middle unit is coupled to the starter unit. In yet another aspect of the embodiment, the top end unit can include a channel defined between a top of the top end unit and a first opening of a bottom of the top end unit, wherein the bottom of the top end unit is coupled to the middle unit. In yet another aspect of the embodiment, the artificial plant barrier system can further include a support core assembly configured to interface with the channels of the starter unit, the middle unit and the top end unit. In yet another aspect of the embodiment, the base support is a mobile base.

In another embodiment of the invention, an artificial plant barrier system can be provided. The system can include a plurality of artificial plant units, where at least one artificial plant unit of the plurality of artificial plant units includes a first artificial plant unit channel defined between a first opening of a top of the artificial plant unit and a second opening of a bottom of the artificial plant unit and the bottom of the artificial plant unit is coupled to a base support. The system further can include another of the plurality of artificial plant units that includes a second artificial plant unit channel defined between a first opening of a top of the artificial plant unit and a second opening of a bottom of the artificial plant unit, wherein the bottom of the artificial plant unit is coupled to the top of the at least one artificial plant unit coupled to the base support.

In another aspect of the embodiment, the system can further include a support core assembly that is configured to interface with the first artificial plant unit channel and the second artificial plant unit channel. In yet another aspect of the embodiment, the system further can include a removable plug that is configured for insertion into the first opening of the second artificial plant unit channel of the at least one artificial plant unit.

In yet another embodiment of the invention, a method for constructing an artificial plant barrier can be provided. The method can include transporting a set of artificial plant units to a desired location and assembling an artificial plant barrier by stacking the set of artificial plant units one on top of the other. In one aspect of the embodiment, the method further can include positioning a first starter unit on the surface upon which the artificial plant barrier is to rest. In another aspect of the embodiment, the method yet further can include providing a first artificial plant unit that includes a first artificial plant unit channel defined between a first opening of a top of the artificial plant unit and a second opening of a bottom of the artificial plant unit and the bottom of the artificial plant unit is coupled to a base support. The method further can provide a second artificial plant unit, that includes a second artificial plant unit channel defined between a first opening of a top of the artificial plant unit and a second opening of a bottom of the artificial plant unit, wherein the bottom of the artificial plant unit is coupled to the top of the at least one artificial plant unit coupled to the base support.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Embodiments of the present invention provide system, method and apparatus for constructing artificial plant hedges or barriers. In one embodiment of the invention, an artificial plant barrier system can be provided. The system can include a starter unit, a middle unit coupled to a top of the starter unit, and a top end unit coupled to a top of the middle unit. In one aspect of the embodiment, the starter unit can include a channel defined between a first opening of a top of the starter unit and a second opening of a bottom of the starter unit, wherein the bottom of the starter unit is coupled to a base support.

In another embodiment of the invention, an alternative artificial plant barrier system can be provided. The system can include a plurality of artificial plant units, where at least one artificial plant unit of the plurality of artificial plant units includes a first artificial plant unit channel defined between a first opening of a top of the artificial plant unit and a second opening of a bottom of the artificial plant unit and the bottom of the artificial plant unit is coupled to a base support. The system further can include another of the plurality of artificial plant units that includes a second artificial plant unit channel defined between a first opening of a top of the artificial plant unit and a second opening of a bottom of the artificial plant unit, wherein the bottom of the artificial plant unit is coupled to the top of the at least one artificial plant unit coupled to the base support.

Figure 1:
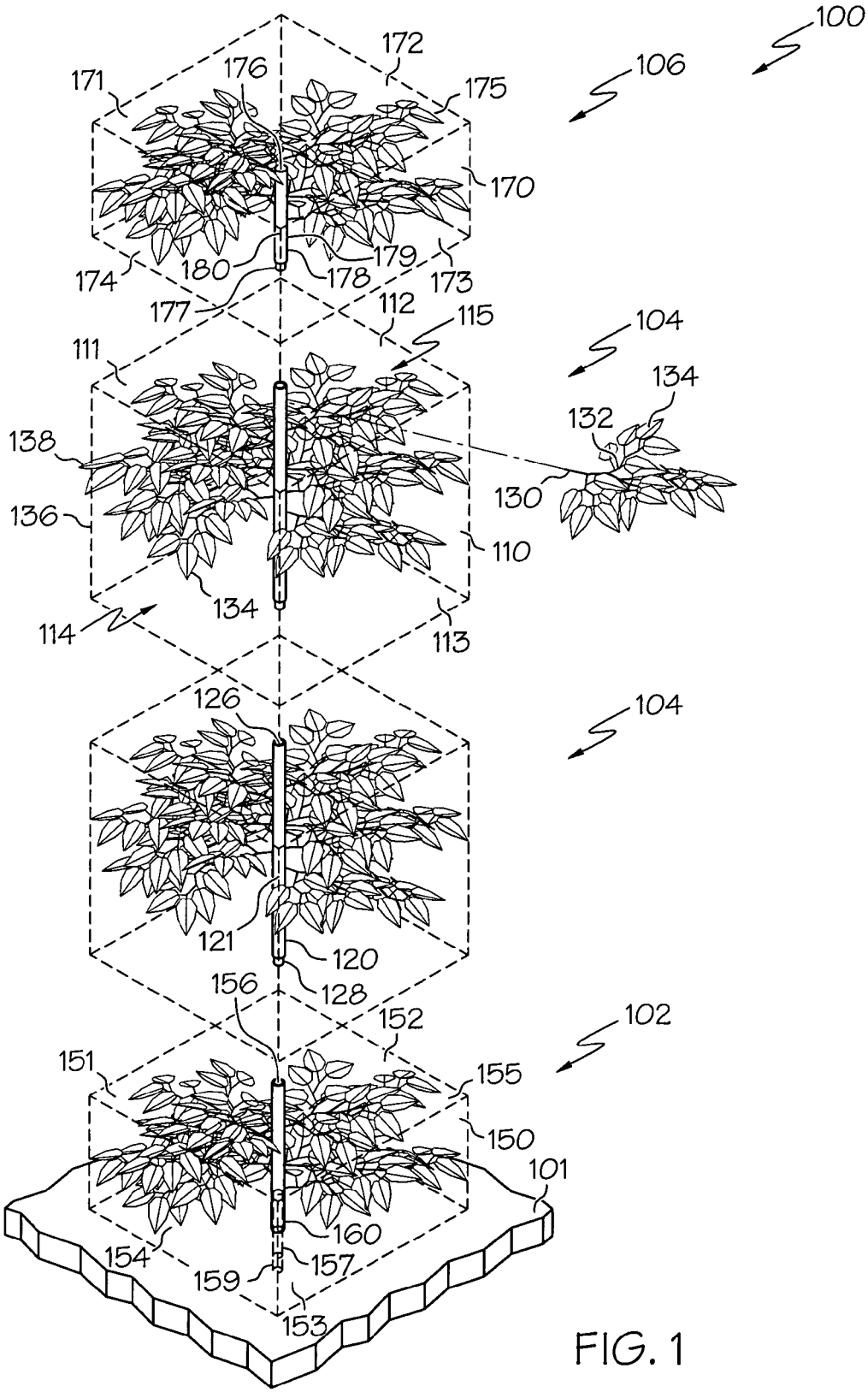
FIG. 1 is a perspective exploded view of an artificial plant barrier system constructed in accordance with the principles of the present invention.

In further illustration, FIG. 1 is a diagram of an artificial plant barrier system constructed in accordance with the principles of the present invention. As shown in FIG. 1, an artificial plant barrier system 100 can include a starter unit 102, one or more middle units 104 and a top end unit 106. The starter unit 102 can have a substantially rectangular or cubed shape. The starter unit 102 can define six surfaces or planes. The starter unit 102 can include a right side 150 and a left side 151 opposite the right side 150. The starter unit 102 also can include a top 152 and a bottom 153 opposite the top 152, and a front 154 and a back 155 opposite the front 154. The top 152 of starter unit 102 can have an opening 156 defining a female connector and the bottom 153 can have an opening 157 defining a male connector. In embodiments, a channel 158 can be defined between the opening 156 defining a female connector and the opening 157 defining a male connector. Channel 158 can be configured to receive a support core assembly, which can be a stabilizing device, such as a metal or plastic rod (not shown). In addition, the opening 156 defining a female connector can be configured to receive a male connector 157 from a middle unit 104 or a top end unit 106. Channel 158 can be contained within a central stem 160 that is designed to realistically simulate the appearance of a live plant central stem.

In embodiments, the opening defining a male connector 157 can be inserted into a connector or receptacle 159 of an anchoring base 101. For example, FIG. 1 illustrates male connector 157 inserted into the receptacle 159 of anchoring base 101. In embodiments, the anchoring base 101 can be made from concrete that is poured around receptacle 159. In embodiments, the anchoring base 101 can be a mobile weighted base, e.g., a rounded metal base plate having a variable base diameter and including a pipe extending in a vertical direction from the metal base plate wherein the pipe defines the receptacle 159. In embodiments, the anchoring base 101 can be a plantable base, e.g., a length of pipe with a set of leg members projecting in horizontal directions from the exterior surface of the pipe. The leg members can be positioned at intervals of about eight inches along the exterior surface of the pipe to form a set of anchoring members. For example, a first set of legs can be welded to the exterior surface of the pipe to form a first "X" shape then a second set of legs can be welded to the exterior surface of the pipe to form a second "X" shape spaced approximately eight inches from the first "X" shape. In embodiments, a third set of legs can be welded to the exterior surface of the pipe to form a third "X" shape spaced approximately eight inches from the second "X" shape. It is contemplated that more or less sets of legs can be welded to the exterior surface of the pipe as is necessary to obtain sufficient anchoring stability. The number of sets of legs and the length of the legs can be varied in order to provide sufficient anchoring stability once the plantable base is buried in the ground.

Alternatively, or in addition to, in embodiments the receptacle 159 can be a stabilizing rod, e.g., a length of metal rod extending out of the anchoring base 101 and configured to engage channel 158 of starter unit 102. The stabilizing rod can extend the full length of channel 158 and engage the channel 121 of middle unit 104. In another embodiment, lengths of wire can be run through channels 121, 158 and 180 of units 102, 104 and 106 to stabilize the artificial plant barrier system 100.

In addition, it is contemplated that the male and female connectors of the units 102, 104 and 106 can be switched or reversed. For example, the male connector 157 and the receptacle 159 of anchoring base 101 can be switched such that the receptacle 159 of anchoring base 101 is a male connector and the connector 157 of the starter unit 102 is a female receptacle. Furthermore, it is contemplated that various connectors can be used as is known in the art. For example, the connector 157 and the connector 156 of starter unit 102 can be a twist connector, a press connector, a pin and hole connector, press button and hole connector, e.g., similar to those found in vacuum cleaners and razor scooters, and other commercially available connectors.

The middle units 104 (also referred to as "artificial plant units") can have a substantially rectangular or cubed shape. The middle unit 104 can define six surfaces or planes. The middle unit 104 can include a right side 110 and a left side 111 opposite the right side 110. The middle unit 104 also can include a top 112 and a bottom 113 opposite the top 112, and a front 114 and a back 115 opposite the front 114. The top 112 can have an opening 126 defining a female connector and the bottom 113 can have an opening 128 defining a male connector. A stem 120 can define a channel 121 between the opening 126 defining a female connector and the opening 128 defining a male connector. Channel 121 can be configured to receive a support core assembly, which can be a stabilizing device, such as a metal or plastic rod (not shown). The opening 126 defining a female connector can be configured to receive a male connector 128 from a middle unit 104 or a top end unit 106.

The central stem 120 can include a plurality of branches 130, a plurality of sub-branches 132 coupled to the plurality of branches 130, and a plurality of leaves 134 coupled to the plurality of sub-branches 132 and the plurality of branches 130. The plurality of branches 130 and the plurality of sub-branches 132 are arranged such that when the plurality of leaves 134 are affixed to the branches 130 and sub-branches 132, the middle unit 104 will emulate the appearance of a groomed section of a living plant barrier or hedge. For example, many living hedges are trimmed or pruned by a gardener to produce a "groomed" hedge. Typically, groomed hedges have a rectangular shape with a hedge length, hedge height and hedge width (or thickness). A person who views one of the groomed hedges may comment that the living hedge appears as a "wall of leaves". In other words, when a living hedge is properly groomed and does not have dead or defoliated branches, it presents the casual observer with an image of a wall or barrier that has the appearance of substantially continuous planar surfaces. The arrangement of the plurality of branches 130, the plurality of sub-branches 132 and the plurality of leaves 134 advantageously presents a "wall of leaves" to the hedge observer to realistically represent a section of a groomed hedge. In embodiments, the plurality of leaves 134 can fully obscure the plurality of branches 130 and the plurality of sub-branches 132 from the hedge observer.

Figure 2:
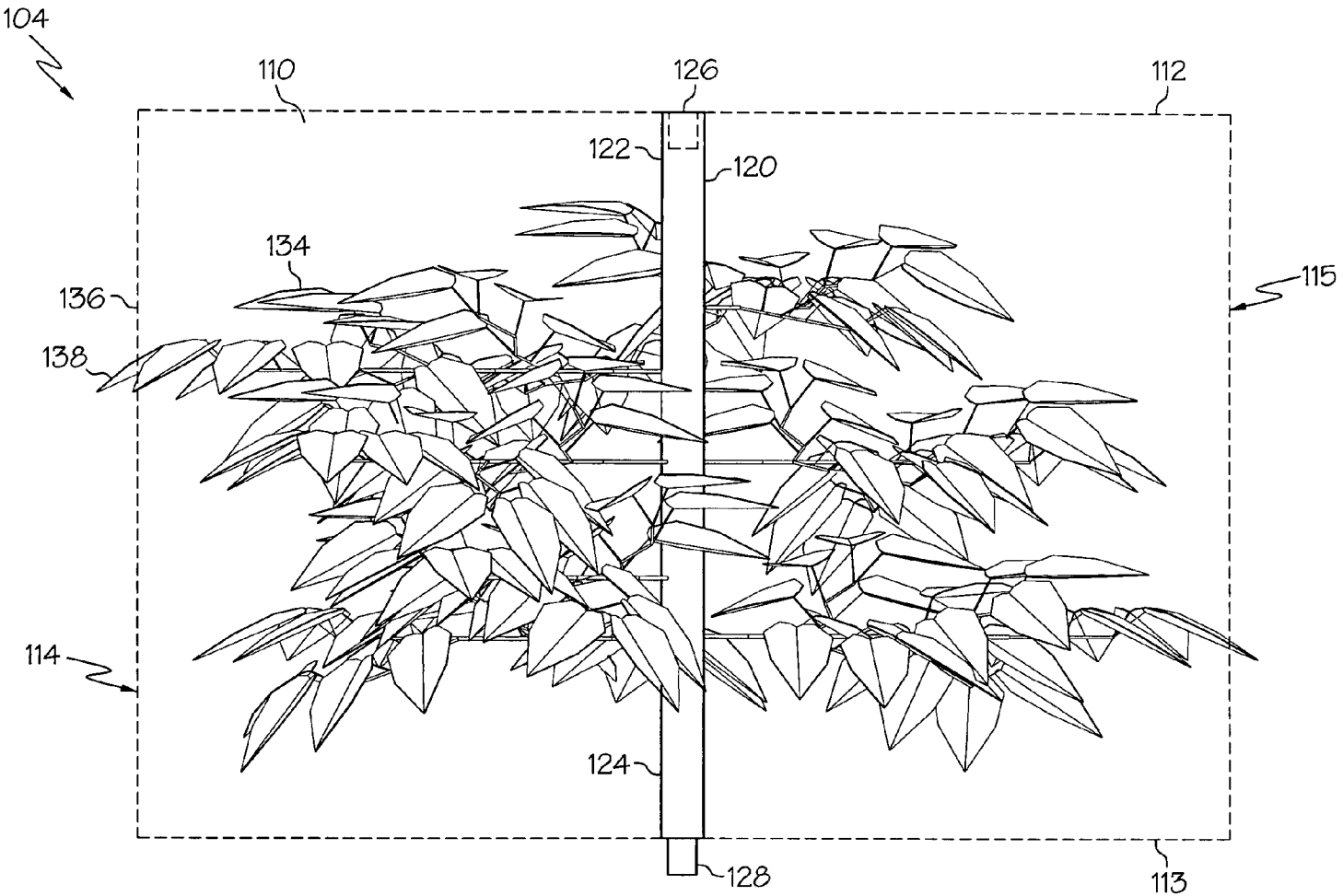
FIG. 2 is a side view of a middle unit of the artificial plant barrier system illustrated in FIG. 1 and constructed in accordance with the principles of the present invention.

In embodiments, in order to provide overlap of foliage between middle units 104, and/or starter unit 102, and/or top end unit 106, the plurality of leaves 134 can extend further than a perimeter of the middle unit 104. For example, referring to FIG. 1, at the intersection 136 of front 114 and left side 111 of middle unit 104, the plurality of leaves 134 can be extended 138 beyond the intersection 136. Referring to FIG. 2, front 114 illustrates the extension 138 of the plurality of leaves 134 from the plane of the front 114. This configuration of the plurality of leaves 134 advantageously provides for concealing the seams that can be formed when the middle units 104, and/or starter unit 102, and/or top end unit 106 are stacked one on top of the next or stacked side by side to assemble the artificial plant barrier system 100.

Notably, the middle units 104, and/or starter unit 102, and/or top end unit 106 can have various sizes and dimensions. For example, the units 102, 104 and 106 can be in the form of cubes having a length of two feet, a height of two feet and a width (or thickness) of two feet. In another embodiment, the units 102, 104 and 106 can be in the form of rectangles, e.g., similar to a brick, having a length of four feet, a height of two feet and a width (or thickness) of two feet. Although the drawings illustrate units 102, 104 and 106 having dimensions corresponding to cubes and/or rectangles, it is contemplated that other shapes, e.g., a disk, ring, triangle, polygon, arches, spheres and the like, and other dimensions, e.g., a disk having a diameter of two feet, a height of four feet and a width (or thickness) of two feet. In embodiments, the units 102, 104 and 106 can have customized shapes and sizes. For example, top end unit 106 can be shaped to represent an archway, a sphere or a part of an animal.

In embodiments, it is also contemplated that the middle units 104 can have multiple stems 120 defining multiple channels 121. This advantageously provides for assembling an artificial plant barrier system 100 where the units 102, 104 and 106 are staggered with respect to one or more other units 102, 104 and 106. The multiple stems 120 defining multiple channels 121 can provide an artificial plant barrier system 100 that is similar in design to a constructed brick wall.

Similar to the starter unit 102 and the one or more middle units 104, the top end unit 106 can have a substantially rectangular or cubed shape. The top end unit 106 can define six surfaces or planes. The top end unit 106 can include a right side 170 and a left side 171 opposite the right side 170. The starter unit 102 also can include a top 172 and a bottom 173 opposite the top 172, and a front 174 and a back 175 opposite the front 174. The top 172 can have an opening 176 defining a female connector and the bottom 173 can have an opening 178 defining a male connector. In embodiments, a stem 179 can define a channel 180 between the opening 176 defining a female connector and the opening 177 defining a male connector. Channel 180 can be configured to receive a support core assembly, which can be a stabilizing device, such as a metal or plastic rod (not shown). The opening 176 defining a female connector can be configured to receive a removable plug (not shown), which can be inserted into the female connector 176 to hide the opening 176 and give the appearance of a substantially flat top section of an artificial plant barrier. The lower portion 178 of channel 180 can be configured to receive a stabilizing device, such as a metal or plastic rod (not shown). In embodiments, channel 180 can partially extend from the bottom 173 to the top 172. In these embodiments, the top 172 will not have the opening 176.

In embodiments, the opening defining a male connector 178 can be inserted into a connector 126 defining a female connector of a middle unit 104 or starter unit 102.

It should also be appreciated that the present invention is not limited to straight rectangular or cubed units. Specifically, arcuate and/or angled units may be provided for use alone, or together with straight units, to produce hedges, fences or barriers of required shapes. In this context, the assemblies are considered to be arrayed along an "extensional direction" of the artificial plant barrier, where the extensional direction may vary along the artificial plant barrier so as to correspond to a straight, curved or angled shape of the desired artificial plant barrier.

In yet further illustration, FIG. 2 is a side view of a middle unit of the artificial plant barrier system shown in FIG. 1 and constructed in accordance with the principles of the present invention. As illustrated in FIG. 2, middle unit 104 of artificial plant barrier system 100 can define six surfaces or planes. The middle unit 104 can include a right side 110 and a left side 111 opposite the right side 110. The middle unit 104 also can include a top 112 and a bottom 113 opposite the top 112, and a front 114 and a back 115 opposite the front 114. The top 112 can have an opening 126 defining a female connector and the bottom 113 can have an opening 128 defining a male connector. A stem 120 can define a channel 121 between the opening 126 defining a female connector and the opening 128 defining a male connector. Notably the plurality of leaves 134 can extend beyond the perimeter 136 of the middle unit 104 to provide overlap of leaves 134 and give the appearance of a live plant barrier.

Figure 3:
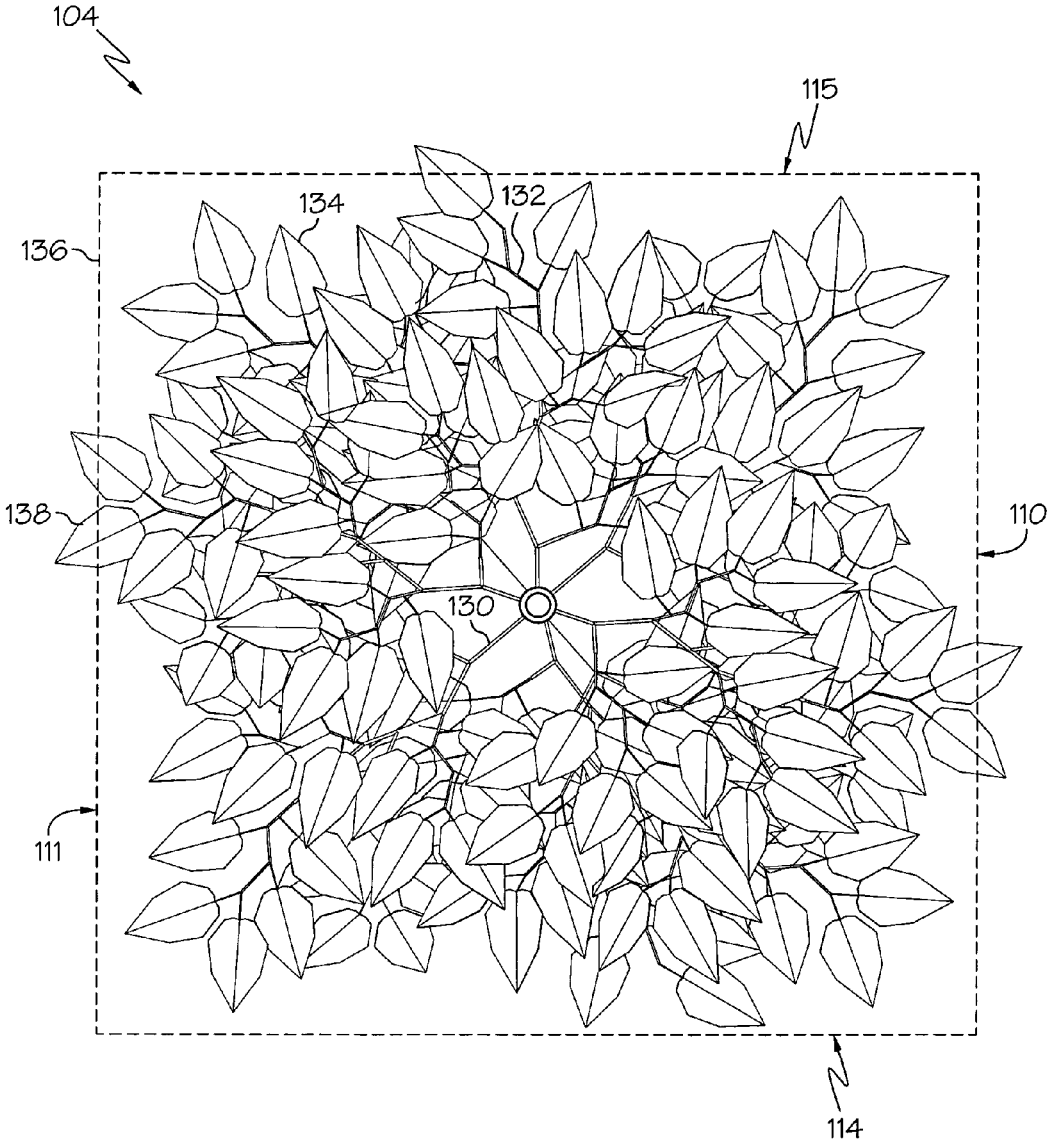
FIG. 3 is a top view of a middle unit of the artificial plant barrier system illustrated in FIG. 1 and constructed in accordance with the principles of the present invention.

In yet further illustration, FIG. 3 is a top view of a middle unit of the artificial plant barrier system shown in FIG. 1 and constructed in accordance with the principles of the present invention. As illustrated in FIG. 3, the top 112 of middle unit 104 can be lacking a full canopy of leaves 134. In this embodiment, a full canopy of leaves 134 is not required as the top end unit 106 can be used to cap the top 112 of middle unit 104. In other embodiments where the top end unit 106 is not being used, the top 112 of middle unit 104 can have a full canopy of leaves 134. In embodiments, each face or plane of middle unit 104 can have a full canopy of leaves 134. This advantageously provides for an artificial plant barrier that can have a single unit design, e.g., a middle unit 104, which can be used to construct the artificial plant barrier system 100 at the desired location.

In operation, the artificial plant barrier system 100 can be implemented to provide a more aesthetically pleasing privacy barrier at a significant cost savings. The process for constructing an artificial plant barrier system 100 can include transporting a set of artificial plant units 102, 104 and/or 106 to a desired location, e.g., a construction area of a hotel, assembling an artificial plant barrier or hedge by stacking the set of artificial plant units 102, 104 and/or 106 one directly above the other or at staggered intervals. The stacking of the set of artificial plant units 102, 104 and/or 106 can include joining a first portion of a connector to a corresponding second portion of a connector. For example, a male connector 157 of starter unit 102 can be inserted into receptacle 159 of anchoring base 101. Alternatively, or in addition to, the process yet further can include inserting a male connector 157 of middle unit 104 into receptacle 159 of anchoring base 101. Once starter unit 102 is properly connected to anchoring base 101, a male connector 157 of middle unit 104 can be inserted into opening 156 of starter unit 102. Once middle unit 104 is properly connected to starter unit 102, a male connector 178 of top end unit 106 can be inserted into opening 126 of middle unit 104. Alternatively, or in addition to, the process yet further can include inserting a male connector 157 of a second middle unit 104 into opening 126 of the first middle unit 104. The process yet further can include inserting a male connector 157 of a third middle unit 104 into opening 126 of the second middle unit 104. Additional middle units 104 can be added to build an artificial plant barrier to a desired height. Although a single stack of plant units 102, 104, 106 is illustrated in the figures, it is contemplated that multiple stacks of plant units 102, 104, 106 will be used to build artificial plant barrier system 100. In addition, the stacks of plant units 102, 104, 106 can also be offset. For example a plant unit 102, 104, 106 can have multiple stems 160, 120 and 179 for staggering the plant units.

The invention has been described with respect to certain preferred embodiments, but the invention is not limited only to the particular constructions disclosed and shown in the drawings as examples, and also comprises the subject matter and such reasonable modifications or equivalents as are encompassed within the scope of the appended claims.

I claim:

1. An artificial plant barrier system comprising:

a base comprising a top face and a bottom face;

a first rectangular volume comprising a front face, rear face, top face, bottom face and side faces, the front face comprising a plurality of artificial leaves; and, a second rectangular volume comprising a front face, rear face, top face, bottom face and side faces, the front face comprising a plurality of artificial leaves, the first rectangular volume being coupled to the base at the bottom face of the first rectangular volume and the top face of the base, the second rectangular volume being coupled to the first rectangular volume at the bottom face of the second rectangular volume and the top face of the first rectangular volume.

2. The system of claim 1, further comprising:

a first channel defined by the first rectangular volume from an opening in the bottom face of the first rectangular volume through the first rectangular volume to an opening at the top face of the first rectangular volume;

a second channel defined by the second rectangular volume from an opening in the bottom face of the second rectangular volume through the second rectangular volume to an opening at the top face of the second rectangular volume; and, a stem coupled to the base and disposed in both the first channel and the second channel.

3. The system of claim 1, wherein the base comprises a plantable base comprising a length of pipe with a set of leg members projecting in horizontal directions from an exterior surface of the pipe.

* * * * *